US010043498B2

(12) United States Patent
Sato

(10) Patent No.: US 10,043,498 B2
(45) Date of Patent: Aug. 7, 2018

(54) SNARE WIRE AND SNARE DRUM

(71) Applicant: HOSHINO GAKKI CO., LTD., Nagoya, Aichi (JP)

(72) Inventor: Naoki Sato, Nagoya (JP)

(73) Assignee: HOSHINO GAKKI CO., LTD., Nagoya (JP)

( * ) Notice: Subject to any disclaimer, the term of this patent is extended or adjusted under 35 U.S.C. 154(b) by 56 days.

(21) Appl. No.: 15/333,145

(22) Filed: Oct. 24, 2016

(65) Prior Publication Data

US 2018/0005611 A1 Jan. 4, 2018

(30) Foreign Application Priority Data

Jul. 4, 2016 (JP) ..... 2016-132506

(51) Int. Cl.
*G10D 13/02* (2006.01)

(52) U.S. Cl.
CPC ..... *G10D 13/025* (2013.01)

(58) Field of Classification Search
CPC ..... G10D 13/02; G10D 13/00
See application file for complete search history.

(56) References Cited

U.S. PATENT DOCUMENTS 5,507,214 A * 4/1996 Hoshino ..... G10D 13/025 84/415
7,728,211 B1 * 6/2010 Gatzen ..... G10D 13/025 84/415
8,193,435 B1 * 6/2012 Lombardi ..... G10D 13/025 84/413

FOREIGN PATENT DOCUMENTS

JP 08-54874 A 2/1996
JP 2003-271129 A 9/2003

* cited by examiner

*Primary Examiner* — Kimberly Lockett

(57) ABSTRACT

A snare wire includes a snare and a pair of attachment tools fixed to opposite end sections of the snare. Each of the attachment tools includes a bonding portion with which the snare is bonded, a catching portion that catches a strap or a cord, and a pressing portion that contacts the strap or the cord caught by the catching portion and is pressed in a direction separating from a drum head. The catching portion is arranged at a position between the center of the drum head and the pressing portion and below the bonding portion.

10 Claims, 6 Drawing Sheets

SNARE WIRE AND SNARE DRUM

BACKGROUND OF THE INVENTION

The present invention relates to a snare wire and a snare drum.

A snare wire includes snares and a pair of attachment tools fixed to opposite end sections of the snares. The snare wire is attached to a snare drum using a strap or a cord caught by the attachment tools. The snare wire is supported in a manner switchable selectively between a position at which the snare wire contacts a lower drum head and a position at which the snare wire is spaced from the drum head. When the snare drum is played, the snare wire is switched to the position at which the snare wire contacts the drum head. In this state, when an upper drum head is struck, the snare wire vibrates and produces sound specific to the snare drum. In this case, to further resonate the sound specific to the snare drum, it is desirable that the entire portions of the snares tightly contact the lower drum head.

Japanese Laid-Open Patent Publications Nos. 8-54874 and 2003-271129 each disclose a snare wire attached to a snare drum using a strap. The snare wire disclosed in Japanese Laid-Open Patent Publication No. 8-54874 includes a plate-like attachment tool curved near the middle as a configuration for causing snares to tightly contact a drum head. The attachment tool has a front plate portion to which the snares are welded and a rear plate portion including an elongated hole through which the strap is passed. The attachment tool also has a catching portion that catches the strap at the position corresponding to the position of the elongated hole, through which the strap is passed. The catching portion is configured by a projection having a substantially U-shaped cross section and projects to the side opposite to the surface to which the snares are welded. In this configuration, when the strap caught by the catching portion is pulled, the strap presses the rear plate portion downward. This rotates the attachment tool as a whole and moves the front plate portion upward toward the drum head. The snares, which are welded to the front plate portion, are thus pressed against the drum head.

Like this snare wire, the snare wire disclosed in Japanese Laid-Open Patent Publication No. 2003-271129 includes a plate-like attachment tool curved near the middle. This attachment tool has a projection on a rear plate portion to which a strap is fixed as a configuration for causing snares to tightly contact a drum head. The projection projects to the same side as the surface to which the snares are welded. The projection is adapted to adjust the height of the rear plate portion of the attachment tool to the height equal to the height of a front plate portion to which the snares are welded such that the thickness of the front plate portion is increased. In this configuration, when the strap fixed to the rear plate portion of the attachment tool is pulled, the projection of the rear plate portion contacts the drum head, thus stopping the front plate portion from being lifted from the drum head. This causes the snares, which are welded to the front plate portion, to tightly contact the drum head.

However, in the invention disclosed in Japanese Laid-Open Patent Publication No. 8-54874, the force by which the strap presses the rear plate portion is small and the force that rotates the attachment tool is correspondingly small when the strap caught by the catching portion is pulled. This hampers reliable pressing of the entire portions of the snares, which are welded to the front plate portion, against the drum head. Also, in the invention disclosed in Japanese Laid-Open Patent Publication No. 2003-271129, the front plate portion of the attachment tool is simply caused to contact the drum head and cannot be reliably pressed against the drum head. Therefore, in the configurations of the snare wires disclosed in the two aforementioned documents, the end sections of the snares, which are welded to the front plate portion, are easily lifted from the drum head compared to the sections of the snares closer to the center of the drum head. This hampers tight contact between the end sections of the snares and the drum head, thus hampering tight contact between the entire portions of the snares and the drum head.

SUMMARY OF THE INVENTION

Accordingly, it is an objective of the present invention to provide a snare wire and a snare drum capable of causing an end section of a snare to tightly contact a drum head.

To achieve the above-described objective, according to a first aspect of the present invention, provided is a snare wire including a snare and a pair of attachment tools fixed to opposite end sections of the snare. Each of the attachment tools of the snare wire includes a bonding portion with which the snare is bonded, a catching portion that catches a pulling member, and a pressing portion that contacts the pulling member caught by the catching portion and is pressed in a direction separating from a drum head. The catching portion is arranged at a position between the center of the drum head and the pressing portion and below the bonding portion.

To achieve the objective, according to a second aspect of the invention, provided is a snare drum including a cylindrical shell, a pair of drum heads closing corresponding upper and lower open ends of the shell, and a snare wire having a snare and a pair of attachment tools fixed to opposite end sections of the snare. Each of the attachment tools of the snare wire includes a bonding portion with which the snare is bonded, a catching portion that catches a pulling member, and a pressing portion that contacts the pulling member caught by the catching portion and is pressed in a direction separating from a corresponding one of the drum heads. The catching portion is arranged at a position between the center of the drum head and the pressing portion and below the bonding portion.

DETAILED DESCRIPTION OF THE PREFERRED EMBODIMENTS

An embodiment of a snare wire 10 according to the present invention will now be described with reference to FIGS. 1 to 7.

Figure 1:
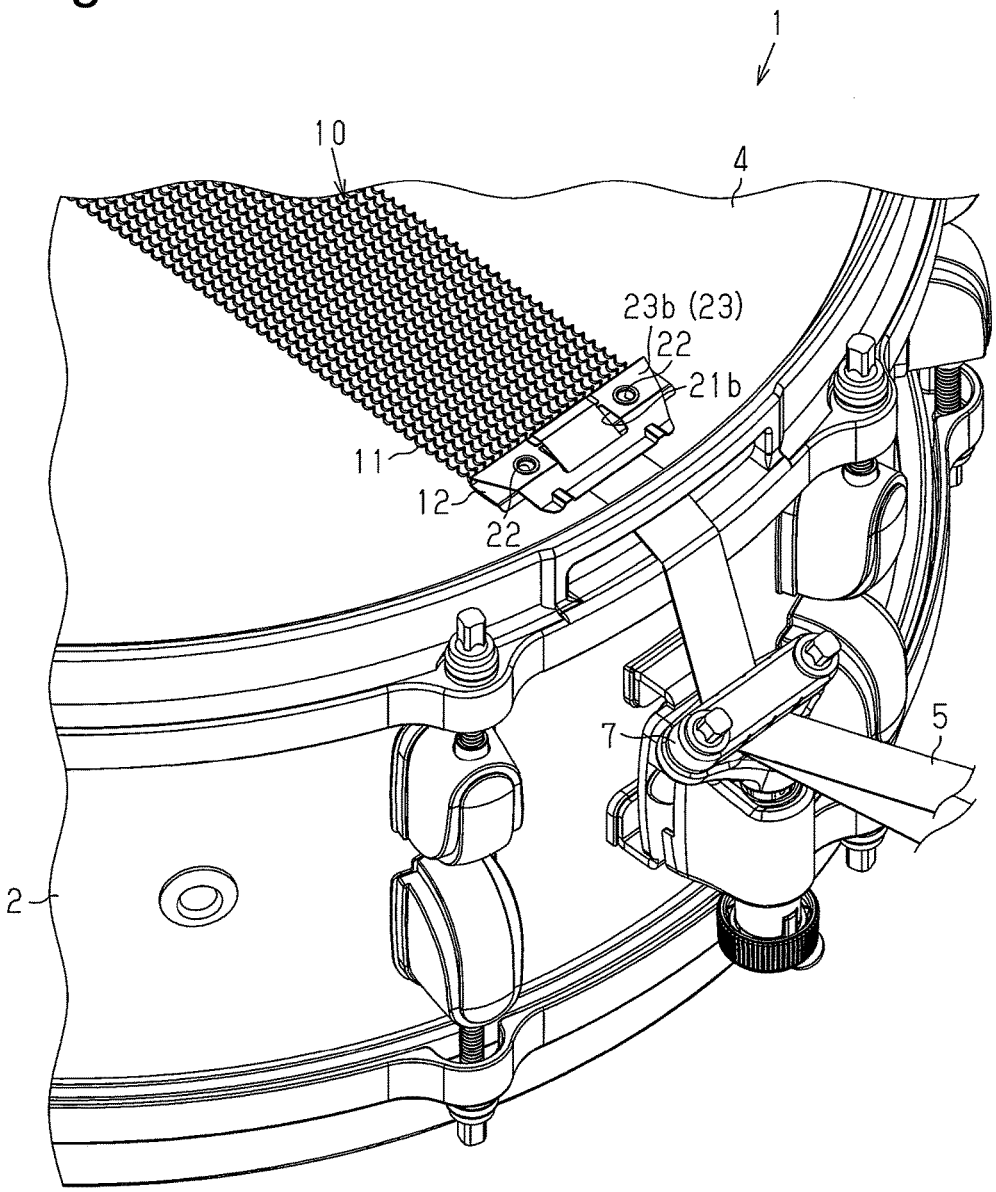
FIG. 1 is a perspective view showing a portion of a snare drum to which a snare wire according to an embodiment of the present invention is attached using a strap.
Figure 2:
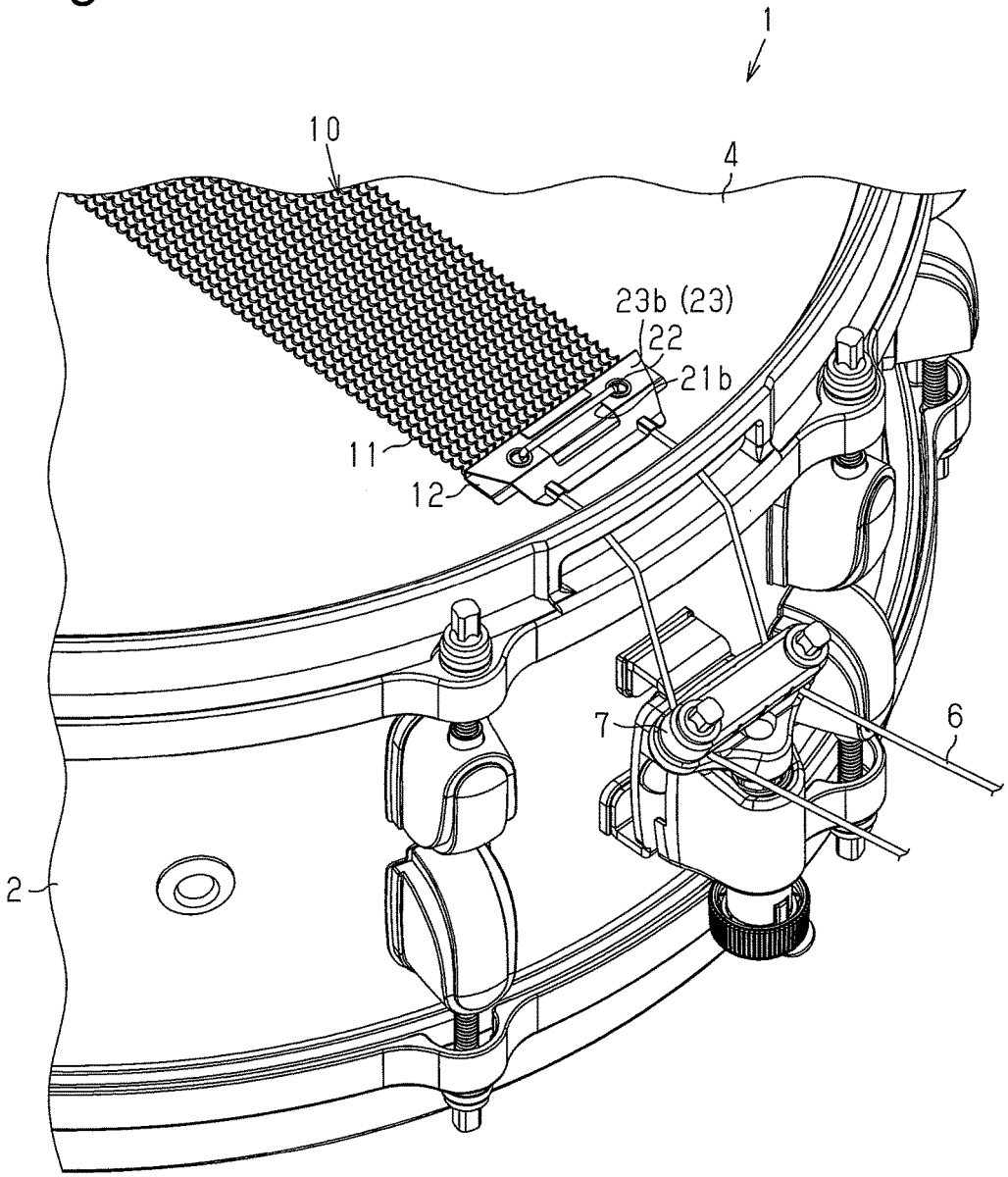
FIG. 2 is a perspective view showing a portion of the snare drum to which the snare wire is attached using a cord.

As shown in FIGS. 1 and 2, a snare drum 1 includes a cylindrical shell 2, a pair of drum heads closing upper and lower open ends of the shell 2, and a snare wire 10. When the snare drum 1 is played, the snare wire 10 vibrates as a non-illustrated upper drum head is struck and repeatedly contacts and separates from a lower drum head 4. This ensures resonance specific to a snare drum. FIGS. 1 and 2 are both represented with the lower drum head 4 facing upward for illustrative purposes.

The snare wire 10 is mounted in tension on a surface of the drum head 4 using a pulling member such as a strap 5 shown in FIG. 1 or a cord 6 shown in FIG. 2. The snare drum 1 also includes a holding tool 7 that is fixed to an outer peripheral surface of the shell 2 and holds the strap 5 or the cord 6. By switching a non-illustrated lever of the holding tool 7, the snare wire 10 is switchable selectively between a position at which the snare wire 10 contacts the drum head 4 and a position at which the snare wire 10 is spaced from the drum head 4.

Figure 3:
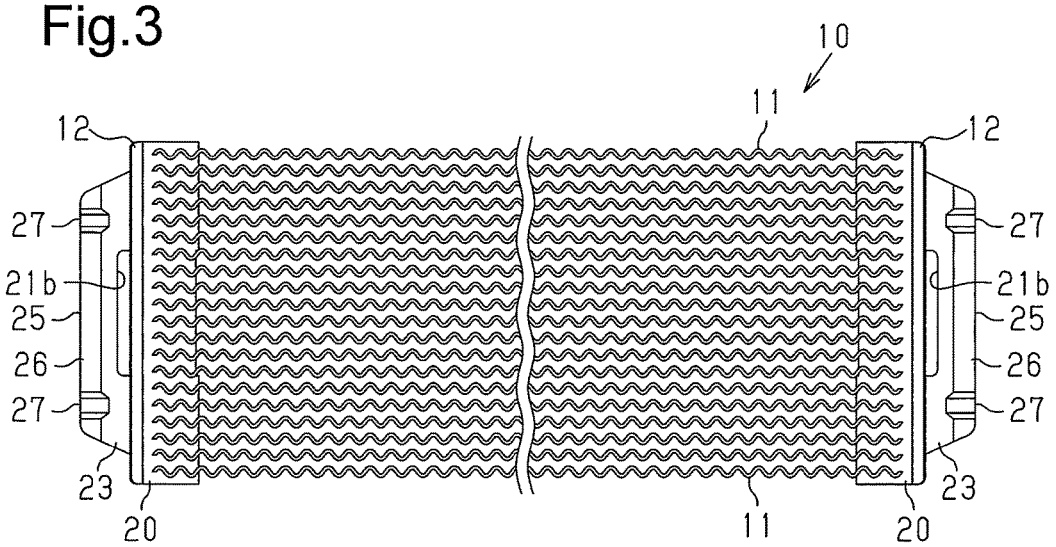
FIG. 3 is a plan view showing the snare wire as viewed from the side corresponding to a drum head.
Figure 4:
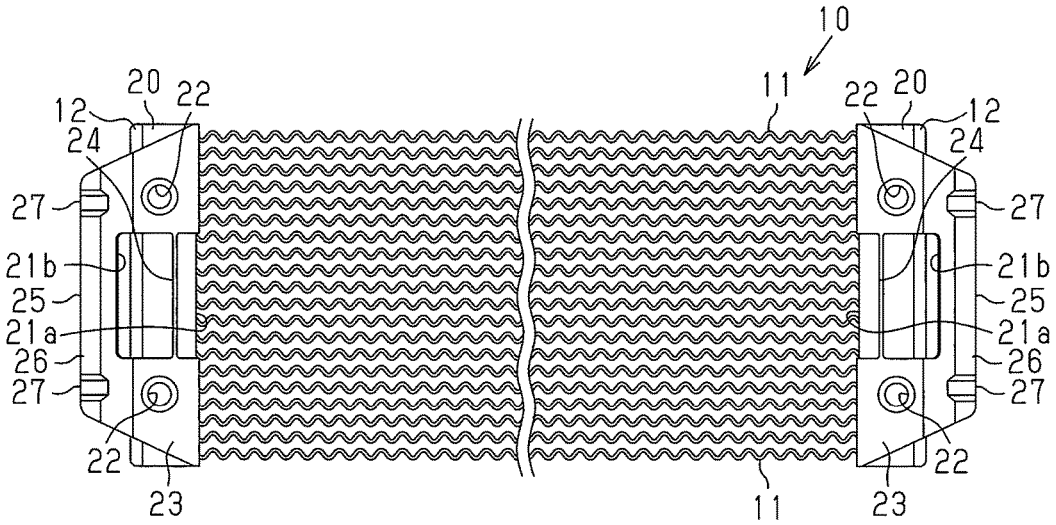
FIG. 4 is a plan view showing the snare wire as viewed from the side opposite to the side corresponding to the drum head.

With reference to FIGS. 3 and 4, the snare wire 10 includes a plurality of snares 11, which are arranged parallel, and a pair of attachment tools 12, which are fixed to corresponding opposite end sections of the snares 11. Each of the attachment tools 12 is an elongated component extending in the direction perpendicular to the longitudinal direction of the snare wire 10. Each attachment tool 12 includes a bonding portion 20 to which the snares 11 are welded, a catching portion 23 that catches the strap 5 or the cord 6, two strap holes 21*a*, 21*b* through which the strap 5 is passed, and a pair of cord holes 22 through which the cord 6 is passed.

Figure 5:
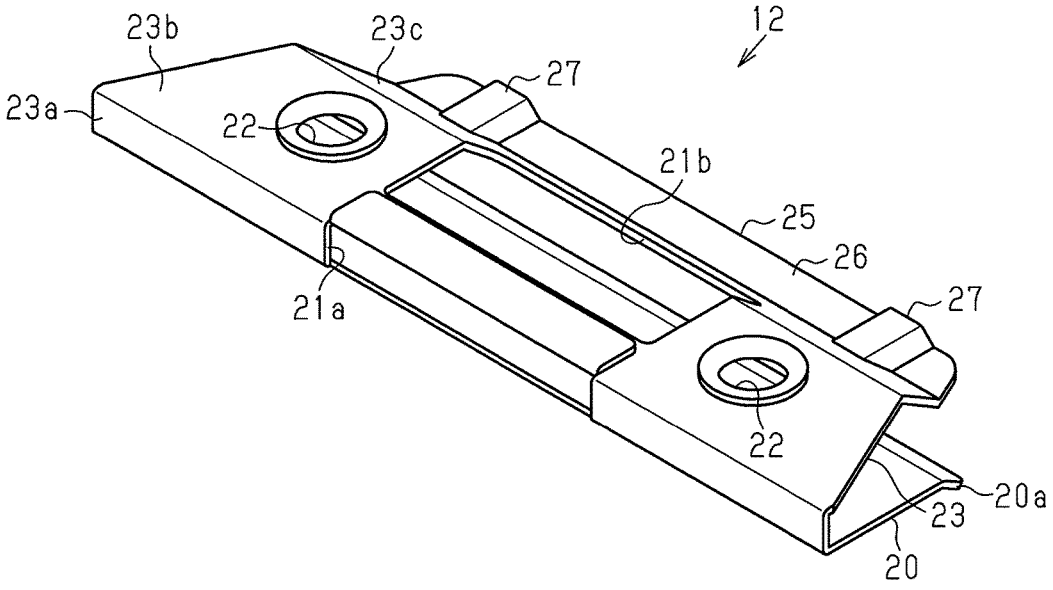
FIG. 5 is a perspective view showing an attachment tool of the snare wire.

Referring to FIG. 5, each attachment tool 12 is formed by bending, in a predetermined shape, a single metal plate punched out in a predetermined shape with the strap holes 21*a*, 21*b* and the cord holes 22. The attachment tool 12 is bent to have a substantially U-shaped cross section as viewed in the direction perpendicular to the longitudinal direction of the snare wire 10. The attachment tool 12 is shaped such that, without force acting on the attachment tool 12, the bonding portion 20 and the catching portion 23 are slightly open about a coupling portion between the bonding portion 20 and the catching portion 23.

The strap holes 21*a*, 21*b* are configured by two differently sized elongated square holes. The relatively small-sized strap hole is the first strap hole 21*a* and the relatively great-sized strap hole is the second strap hole 21*b*. The second strap hole 21*b* and the two cord holes 22 have openings in a common surface of the catching portion 23. The cord holes 22 are configured by round holes that are sized and shaped identically with each other. Referring to FIG. 4, as viewed in the longitudinal direction of the snare wire 10, the cord holes 22 are arranged at positions substantially corresponding to the position of the second strap hole 21*b*. Specifically, as viewed in the longitudinal direction of the snare wire 10, the center position of the cord hole 22 is located between the center of the second strap hole 21*b* and an elongated side 24 of the second strap hole 21*b*, which is closer to the snares 11.

Figure 6:
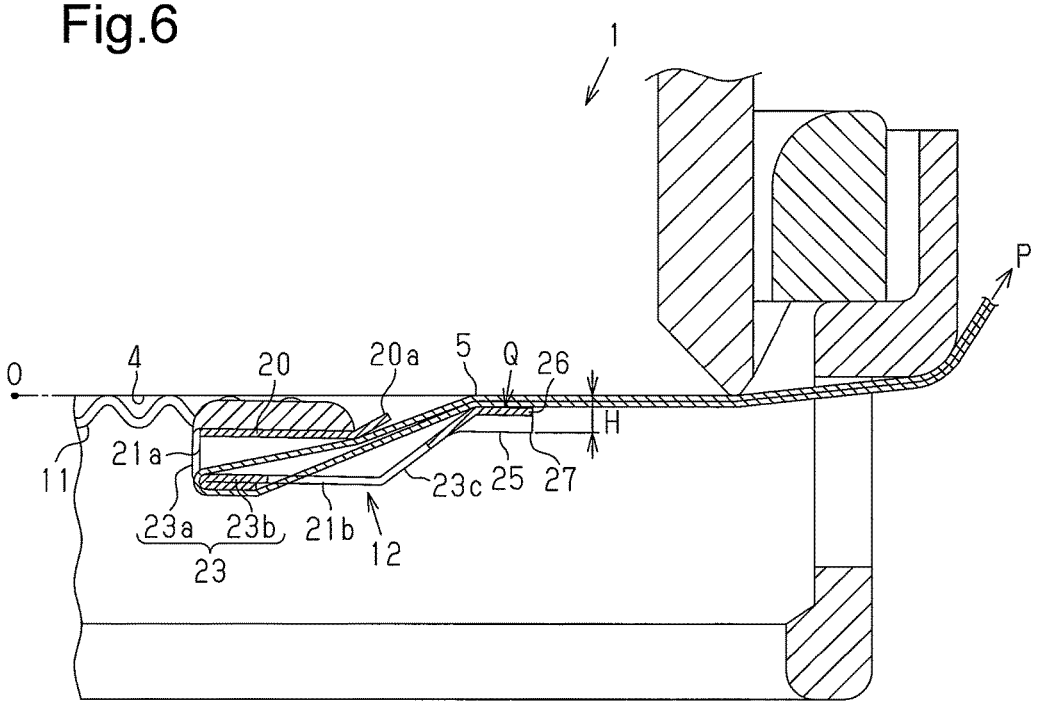
FIG. 6 is a cross-sectional view showing a portion of the snare drum to which the snare wire is attached using the strap.
Figure 7:
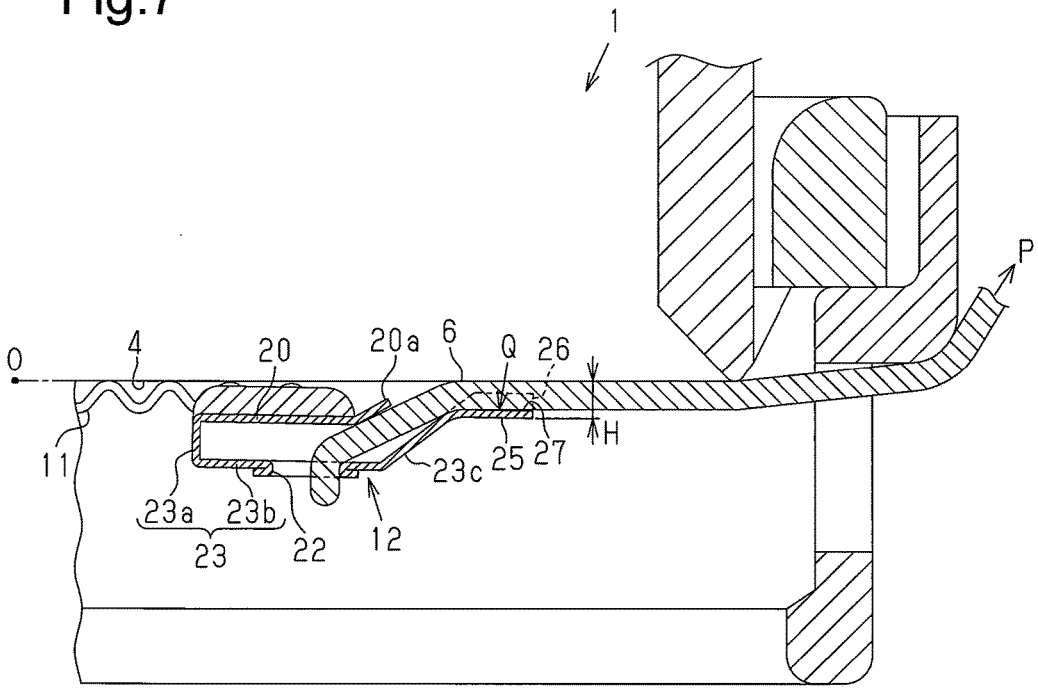
FIG. 7 is a cross-sectional view showing a portion of the snare drum to which the snare wire is attached using the cord.

As illustrated in FIGS. 6 and 7, each attachment tool 12 also includes an extending portion 20*a*, which extends diagonally upward from a distal end of the bonding portion 20. The extending portion 20*a* is a flat section adjacent to the bonding portion 20 and forms one of opposite end sections of the attachment tool 12. The extending portion 20*a* extends substantially in the same direction as the strap 5 or the cord 6 caught by the catching portion 23. The extending portion 20*a* is arranged at such a position that the extending portion 20*a* is capable of contacting the strap 5 or the cord 6 caught by the catching portion 23.

The catching portion 23 is a portion that has an L-shaped cross section and is located below the bonding portion 20, thus forming a middle section of the attachment tool 12. The catching portion 23 is configured by a first catching portion 23*a*, which extends downward from a basal end of the bonding portion 20, and a second catching portion 23*b*, which extends from the first catching portion 23*a* parallel to the bonding portion 20. As illustrated in FIGS. 4 and 5, the first strap hole 21*a* is formed in the middle of the first catching portion 23*a*. The second strap hole 21*b* is formed in the second catching portion 23*b*, together with the two cord holes 22. Since the second strap hole 21*b* is formed in the middle of the second catching portion 23*b*, the second strap hole 21*b* is arranged at the position corresponding to the position of the first strap hole 21*a* as viewed in the longitudinal direction of the attachment tool 12.

As illustrated in FIGS. 6 and 7, as viewed in the longitudinal direction of the snare wire 10, the catching portion 23 is arranged between the center O of the drum head 4 and a pressing portion 25, which will be described later. Specifically, a contact position at which the strap 5 is caught by and contacts the catching portion 23 and contact positions at which the cord 6 is caught by and contacts the catching portion 23 are located below the bonding portion 20. With reference to FIGS. 1 and 6, the strap 5 is caught by the portion of the second catching portion 23*b* between the first strap hole 21*a* and the second strap hole 21*b*. Referring to FIGS. 2 and 7, the cord 6 is caught by the portion of the second catching portion 23*b* between the two cord holes 22. Since the first strap hole 21*a* is formed in the first catching portion 23*a*, the strap 5 is caught by the catching portion 23 at a position closer to the center O of the drum head 4 than the cord 6.

As illustrated in FIGS. 5, 6, and 7, the portion of the catching portion 23 that catches the strap 5 is formed by bending the portion of the first catching portion 23*a* in which the first strap hole 21*a* is formed in an outward direction. That is, the portion of the catching portion 23 that catches the strap 5 is formed substantially in a rectangular shape, as viewed from above, by arranging the metal plate in a manner layered with the portion of the second catching portion 23*b* between the first strap hole 21*a* and the second strap hole 21*b*. The portions of the catching portion 23 that catch the cord 6 is formed by bending the portions of the second catching portion 23*b* in which the cord holes 22 are formed in an outward direction. That is, each of the portions of the catching portion 23 that catches the cord 6 is formed substantially in an annular shape, as viewed from above, by arranging the metal plate in a manner layered with the peripheral section of the corresponding cord hole 22 in the second catching portion 23*b*. The portion of the catching portion 23 in which the strap 5 is caught by and contacts the catching portion 23 and the portions of the catching portion 23 in which the cord 6 is caught by and contacts the catching portion 23 are each formed in an R shape by bending the metal plate by 180°.

Each attachment tool 12 also includes a continuous portion 23*c*, which extends diagonally upward from an end section of the catching portion 23, and a pressing portion 25, which extends horizontally from the distal end of the continuous portion 23*c*. The continuous portion 23*c* extends substantially parallel to the extending portion 20*a* and forms the portion that connects the pressing portion 25 and the catching portion 23 to each other. The continuous portion 23*c* is arranged downward with respect to the strap 5 or the cord 6 caught by the catching portion 23. The continuous portion 23*c* is extended continuously to the pressing portion 25 such that the continuous portion 23*c* and the pressing portion 25 form an obtuse angle. The second strap hole 21*b* is formed to include an area in the second catching portion 23*b* and an area in the continuous portion 23*c*.

The pressing portion 25 is the portion pressed by the strap 5 or the cord 6 caught by the catching portion 23 and forms the other one of the opposite end sections of each attachment tool 12. The pressing portion 25 is arranged at such a position that the pressing portion 25 is capable of contacting the strap 5 or the cord 6 caught by the catching portion 23. The pressing portion 25 is pressed in a direction separating from the drum head 4 by the strap 5 or the cord 6 caught by the catching portion 23.

As illustrated in FIGS. 4 and 5, the pressing portion 25 includes a flat section 26, which contacts the strap 5 caught by the catching portion 23, and a pair of engagement recesses 27, which become engaged with the cord 6 caught by the catching portion 23. The engagement recesses 27 are formed at positions substantially corresponding to the positions of the two cord holes 22. Specifically, to linearly guide the cord 6 passed through the cord holes 22 and pulled toward the holding tool 7 shown in FIG. 2, the engagement recesses 27 are formed at the positions substantially corresponding to the positions of the cord holes 22. The engagement recesses 27 are each formed by denting corresponding sections of the flat section 26 in a direction in which the flat section 26 is pressed by the strap 5 or the cord 6. Each of the engagement recesses 27 has a depth corresponding to the diameter of the cord 6. Referring to FIGS. 6 and 7, the depth of each engagement recess 27 is set to the value obtained by subtracting the thickness of the strap 5 in the layered state from the diameter of the cord 6. This ensures an equal height H of the pressing portion 25 including the strap 5 or the cord 6 for the state shown in FIG. 6 in which the snare wire 10 is attached to the drum head 4 using the strap 5 and the state shown in FIG. 7 in which the snare wire 10 is attached to the drum head 4 using the cord 6. As a result, an equal inclination of each attachment tool 12 with respect to the drum head 4 is ensured for the state shown in FIG. 6 using the strap 5 and the state shown in FIG. 7 using the cord 6. The end sections of the snares 11 are thus caused to tightly contact the drum head 4 without being lifted from the drum head 4, regardless of whether the strap 5 or the cord 6 is used for the snare wire 10.

Operation of the above-described snare wire 10 will now be described with reference to FIGS. 6 and 7.

When the snare drum 1 is played, to cause the snare wire 10 to contact the drum head 4, the strap 5 or the cord 6 is pulled in the direction of arrow P of FIGS. 6 and 7 in a state caught by the catching portion 23. As indicated by arrow Q of the drawings, the strap 5 or the cord 6 caught by the catching portion 23 thus presses the pressing portion 25 downward, which is the direction separating from the drum head 4. This rotates each attachment tool 12 as a whole clockwise as viewed in FIGS. 6 and 7, thus moving the bonding portion 20, which is at the opposite side to the pressing portion 25, upward toward the drum head 4. In this manner, the snares 11 bonded with the bonding portion 20 are pressed against the drum head 4.

In the present embodiment, the catching portion 23 is arranged at a position between the center O of the drum head 4 and the pressing portion 25 and below the bonding portion 20. Such arrangement of the catching portion 23, the pressing portion 25, and the bonding portion 20 ensures efficient use of tensile force generated by pulling the strap 5 or the cord 6 in the direction of arrow P as force acting in the direction of arrow Q, which presses the pressing portion 25. This increases the force by which the strap 5 or the cord 6 presses the pressing portion 25, thus increasing the force rotating each attachment tool 12. The force pressing the snares 11 against the drum head 4 is thus increased.

At this time, the extending portion 20*a* is pressed upward by the strap 5 or the cord 6 caught by the catching portion 23. This causes the strap 5 or the cord 6 to press the bonding portion 20 as a whole, together with the extending portion 20*a*, upward toward the drum head 4. The force rotating each attachment tool 12 is thus increased. Additionally, since the extending portion 20*a* is pressed directly by the strap 5 or the cord 6, the force pressing the snares 11 against the drum head 4 is further increased.

The present embodiment has the advantages described below.

(1) The catching portion 23 is arranged at a position between the center O of the drum head 4 and the pressing portion 25 and below the bonding portion 20. In this configuration, by arranging the catching portion 23 at a position between the center O of the drum head 4 and the pressing portion 25 and below the bonding portion 20, the pressing portion 25 is pressed downward by the strap 5 or the cord 6 caught by the catching portion 23. This rotates each attachment tool 12 as a whole, thus moving the bonding portion 20, which is located above the catching portion 23, upward toward the drum head 4. The snares 11, which are bonded with the bonding portion 20, are thus pressed against the drum head 4. At this time, since the catching portion 23 is arranged below the bonding portion 20, the force rotating the attachment tool 12 is increased and the force pressing the snares 11 against the drum head 4 is increased. The end sections of the snares 11 are thus caused to tightly contact the drum head 4 without being lifted from the drum head 4. As a result, the entire portions of the snares 11 are caused to tightly contact the drum head 4.

(2) The contact position at which the strap 5 contacts the catching portion 23 and the contact positions at which the cord 6 contacts the catching portion 23 are arranged below the bonding portion 20. In this configuration, by arranging the contact position of the strap 5 or the cord 6 with respect to the catching portion 23 below the bonding portion 20, force transmission from the strap 5 or the cord 6 caught by the catching portion 23 to the pressing portion 25 is facilitated. This further increases the force rotating the attachment tool 12, thus increasing the force pressing the snares 11 against the drum head 4. As a result, the end sections of the snares 11 are easily caused to tightly contact the drum head 4 without being lifted from the drum head 4.

(3) Each attachment tool 12 is bent to have a substantially U-shaped cross section as viewed in the direction perpendicular to the longitudinal direction of the snare wire 10. In this configuration, by being formed to have the U-shaped cross section, the attachment tool 12 is provided with elastic force generated due to the shape of the attachment tool 12. This ensures use of the elastic force of the attachment tool 12 as the force pressing the snares 11 against the drum head 4. In this manner, the snares 11, which are welded to the bonding portion 20, are caused to tightly contact the drum head 4 uniformly without biting into the drum head 4.

(4) The continuous portion 23*c* is arranged downward with respect to the strap 5 or the cord 6 caught by the catching portion 23. In this configuration, by arranging the continuous portion 23*c* downward with respect to the strap 5 or the cord 6 caught by the catching portion 23, contact between the strap 5 or the cord 6 and the continuous portion 23*c* is restrained. The contact portion between the strap 5 or the cord 6 and the attachment tool 12 is thus restricted to the catching portion 23 and the pressing portion 25. Therefore, even if the strap 5 or the cord 6 is formed of soft material such as leather, plastic, or fiber, damage caused in the strap 5 or the cord 6 by contacting the attachment tool 12 is decreased.

(5) The continuous portion 23*c* is extended continuously to the pressing portion 25 such that the continuous portion 23*c* and the pressing portion 25 form an obtuse angle. Also, the portion of the catching portion 23 in which the strap 5 is caught by and contacts the catching portion 23 and each portion of the catching portion 23 in which the cord 6 is caught by and contacts the catching portion 23 both have an R shape. In this configuration, the continuous portion 23*c* and the pressing portion 25 form an obtuse angle, damage caused in the strap 5 or the cord 6 by contacting the pressing portion 25 is decreased. Also, since the contact portion between the strap 5 or the cord 6 and the catching portion 23 has the R shape, damage caused in the strap 5 or the cord 6 by contacting the catching portion 23 is decreased.

(6) Each attachment tool 12 further includes the extending portion 20*a*, which extends diagonally upward from the distal end of the bonding portion 20. In this configuration, the extending portion 20*a* is pressed upward by the strap 5 or the cord 6 caught by the catching portion 23. The bonding portion 20 as a whole is thus pressed upward toward the drum head 4, together with the extending portion 20*a*, by the strap 5 or the cord 6. The end sections of the snares 11 are thus further easily caused to tightly contact the drum head 4 without being lifted from the drum head 4.

(7) The first strap hole 21*b* and the cord holes 22 have openings in a common surface of the catching portion 23. In this configuration, the contact position at which the strap 5 contacts the catching position 23 can be set to the position corresponding to the contact position at which the cord 6 contacts the catching portion 23. The end sections of the snares 11 are thus caused to tightly contact the drum head 4 without being lifted from the drum head 4, regardless of whether the strap 5 or the cord 6 is used for the pulling member. Therefore, it is possible to provide a snare wire 10 capable of being applied to both of the strap 5 and the cord 6.

(8) The pressing portion 25 includes the flat section 26, which contacts the strap 5 caught by the catching portion 23, and the two engagement recesses 27, which are engaged with the cord 6 caught by the catching portion 23. In this configuration, when the pressing portion 25 is pressed by the strap 5 or the cord 6 caught by the catching portion 23, the strap 5 is caused to contact the flat section 26 and the cord 6 is engaged with the engagement recesses 27. This ensures an equal height of the pressing portion 25 including the strap 5 or the cord 6 for the case using the strap 5 and the case using the cord 6. As a result, regardless of whether the strap 5 or the cord 6 is used, the end sections of the snares 11 are easily caused to tightly contact the drum head 4 without being lifted from the drum head 4.

The present embodiment may be modified to the forms described below.

Figure 8:
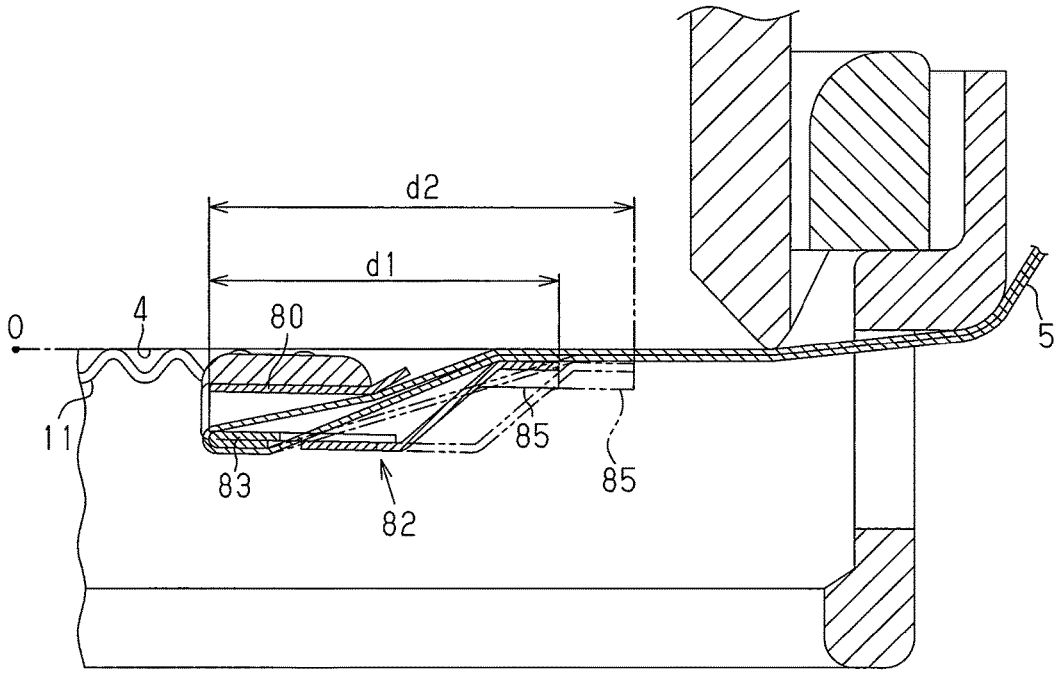
FIG. 8 is a cross-sectional view showing a portion of a snare drum to which a snare wire of another example is attached.

As shown in FIG. 8, an attachment tool 82 may be adapted to be capable of changing the distance between a catching portion 83 and a pressing portion 85. In this configuration, the distance between the catching portion 83 and the pressing portion 85 may be changed between distance d1 and distance d2. This ensures adjustment of the force transmitted from the strap 5 or the cord 6 caught by the catching portion 83 to the pressing portion 85. The force rotating the attachment tool 82 is thus adjusted. In this manner, the force pressing the snares 11, which are welded to a bonding portion 80, against the drum head 4 is adjusted to an appropriate level. As a result, the sound or resonance specific to the snare drum can be adjusted depending on preference by the player.

The catching portion 23 may be arranged at any suitable position as long as the position is between the center O of the drum head 4 and the pressing portion 25 and below the bonding portion 20. For example, the contact position at which the strap 5 contacts the catching portion 23 and the contact positions at which the cord 6 contacts the catching portion 23 may be arranged between the center O of the drum head 4 and the bonding portion 20 at any suitable positions other than the positions corresponding to the bonding portion 20, as viewed in the longitudinal direction of the snare wire 10.

Each attachment tool 12 may be formed in any suitable shape as long as the bonding portion 20 and the catching portion 23 are arranged between the center O of the drum head 4 and the pressing portion 25 and the catching portion 23 is arranged below the bonding portion 20.

The portion in which the continuous portion 23*c* is extended continuously to the pressing portion 25 may have a flat shape or an R shape, other than the shape having an obtuse angle.

The extending portion 20*a* may be omitted from the distal end of the bonding portion 20.

The second strap hole 21*b* and the cord holes 22 do not necessarily have openings in a common surface of the catching portion 23. For example, the first and second strap holes 21*a*, 21*b* may both be formed in the first catching portion 23*a* and the cord holes 22 may be formed in the second catching portion 23*b*.

The two engagement recesses 27 may be omitted from the pressing portion 25. In this case, the cord 6 caught by the catching portion 23 contacts the flat section 26.

The snare wire 10 is adapted for both use with the strap 5 and use with the cord 6. However, either the first and second strap holes 21*a*, 21*b* or the cord holes 22 may be eliminated to provide a snare wire adapted for use specific with a strap or use specific with a cord.

The invention claimed is:

1. A snare wire comprising a snare and a pair of attachment tools fixed to opposite end sections of the snare, wherein each of the attachment tools includes:

a bonding portion with which the snare is bonded;

a catching portion that catches a pulling member; and a pressing portion that contacts the pulling member caught by the catching portion and is pressed in a direction separating from a drum head, the catching portion is arranged at a position between a center of the drum head and the pressing portion, and the catching portion is located below the bonding portion to overlap with the bonding portion when viewed from a vertical direction of the attachment tool.

2. The snare wire according to claim 1, wherein a contact position at which the pulling member contacts the catching portion is arranged below the bonding portion.

3. The snare wire according to claim 1, wherein each of the attachment tools is formed to have a U-shaped cross section as viewed in a direction perpendicular to a longitudinal direction of the snare wire.

4. The snare wire according to claim 1, wherein each attachment tool further has a continuous portion by which the pressing portion and the catching portion are connected to each other, and the continuous portion is arranged downward with respect to the pulling member caught by the catching portion.

5. The snare wire according to claim 4, wherein the continuous portion is extended continuously to the pressing portion such that the continuous portion and the pressing portion form an obtuse angle, and a contact portion between the pulling member and the catching portion has an R shape.

6. The snare wire according to claim 1, wherein each attachment tool further has an extending portion at a distal end of the bonding portion, and the extending portion is arranged at such a position that the extending portion is capable of contacting the pulling member caught by the catching portion, the extending portion extending in a same direction as the pulling member caught by the catching portion.

7. The snare wire according to claim 1, wherein the pulling member is a strap or a cord, each attachment tool has a strap hole through which the strap is passed and a cord hole through which the cord is passed, and the strap hole and the cord hole have openings in a common surface of the catching portion.

8. The snare wire according to claim 7, wherein the pressing portion includes a flat section that contacts the strap caught by the catching portion and an engagement recess that becomes engaged with the cord caught by the catching portion, and the engagement recess is formed by denting a portion of the flat section by a dimension corresponding to a diameter of the cord.

9. The snare wire according to claim 1, wherein each attachment tool is adapted to be capable of changing a distance between the catching portion and the pressing portion.

10. A snare drum comprising a cylindrical shell, a pair of drum heads closing corresponding upper and lower open ends of the shell, and a snare wire having a snare and a pair of attachment tools fixed to opposite end sections of the snare, wherein each of the attachment tools includes:

a bonding portion with which the snare is bonded;

a catching portion that catches a pulling member; and a pressing portion that contacts the pulling member caught by the catching portion and is pressed in a direction separating from a corresponding one of the drum heads, the catching portion is arranged at a position between a center of the drum head and the pressing portion, and the catching portion is located below the bonding portion to overlap with the bonding portion when viewed from a vertical direction of the attachment tool.

* * * * *